US006769142B2

(12) United States Patent
Ragsdale et al.

(10) Patent No.: US 6,769,142 B2
(45) Date of Patent: Aug. 3, 2004

(54) POSITIVE DRIVE COVER SYSTEM

(76) Inventors: Kelly J. Ragsdale, 66 E. 3335 South, Salt Lake City, UT (US) 84115; Cory Brady, 66 E. 3335 South, Salt Lake City, UT (US) 84115

( * ) Notice: Subject to any disclaimer, the term of this patent is extended or adjusted under 35 U.S.C. 154(b) by 159 days.

(21) Appl. No.: 10/241,287

(22) Filed: Sep. 9, 2002

(65) Prior Publication Data

US 2004/0117904 A1 Jun. 24, 2004

(51) Int. Cl.[7] ..... E04H 4/00
(52) U.S. Cl. ..... 4/502; 160/331
(58) Field of Search ..... 4/498, 500–503; 160/84.02, 327, 331

(56) References Cited

U.S. PATENT DOCUMENTS 2,754,900 A * 7/1956 Karobonik et al. ..... 4/502
5,701,613 A * 12/1997 Richardson ..... 4/502

* cited by examiner

*Primary Examiner*—Tuan N. Nguyen
(74) *Attorney, Agent, or Firm*—Holme Roberts & Owen

(57) ABSTRACT

A swimming pool cover fabric has beads attached to its opposite edges. Each bead is positioned to essentially abut the bead in front to form in effect a segmented rod. A drive mechanism has a sprocket to engage each bead and urge it into and out of the race or slot in a track sized to receive the beads. A reversible motor is connected to drive the sprocket to urge the beads and, in turn, the pool cover fabric between open and closed positions.

22 Claims, 6 Drawing Sheets

POSITIVE DRIVE COVER SYSTEM

BACKGROUND OF THE INVENTION

1. Field of the Invention

The invention relates to systems for retractably positioning a cover over an opening of a space to be enclosed and, more particularly, to systems for retractably positioning a cover over a swimming pool.

2. State of the Art

The use of swimming pool covers on conventional residential-type swimming pools is well known and examples of such are described in U.S. Pat. No. 5,913,613 (Ragsdale et al.) and U.S. Pat. No. 5,920,922 (Ragsdale et al.). As discussed in the foregoing references, pool covers are becoming standard equipment for maximizing pool safety as well as reducing unwanted debris from entering the swimming pool when not in use. In addition, the use of pool covers reduces heat loss from heated pool water and can also be used to absorb the sun's rays to heat the pool water during daylight hours.

Many motorized pool-covering apparatuses include a recessed well or a raised housing positioned at one end thereof and have mounted therein an elongated drum fixed to a rotatable shaft which in turn is connected to an electric motor. An impervious, flexible pool cover is secured, at one of its ends, to the cover-collecting drum and is collectable thereon by rotational movement of the drum. The pool cover is extended over the top of the swimming pool by attaching draw cords to both sides of the pool cover as longitudinal extensions thereof and extending the draw cords the length of the pool and around a pulley rotatably fixed to the other side thereof. On most of the pool covers now in use, the draw cord is returned and secured to a collecting reel which is rotatably carried on the same elongated shaft that carries the cover-collecting drum. In some versions, one collecting reel is carried on one side of the drum and the other is carried on the other side. In other versions, both reels are positioned next to each other with pulleys positioned to direct the draw cords to the appropriate reel. A clutching mechanism is used to engage the drum or reels to affect opening and closing.

The prior art systems, although effective for the purposes designed, on occasion damage the pool cover fabric during the time it is being retracted on the collecting drum. Tearing or ripping of the cover fabric can occur when one side of the cover fabric is collected on the drum at a rate faster than the other side. Eventually, the cover fabric is damaged. Systems to avoid this problem and to avoid costly repairs of the pool cover fabric are not known.

SUMMARY OF THE INVENTION

A system for extending and retracting a cover, which is sometimes called a fabric, over an opening of a space to be enclosed includes a cover which is shaped and sized for positioning over the opening of the space to be enclosed. The cover is moveable between a closed position in which the cover substantially covers the opening and an open position in which the cover is displaced from the closed position. The cover has a front edge, a first side edge and a second side edge spaced from the first side edge. The first side edge has a length and a first plurality of bead members disposed along the length. The second side edge has a length and a second plurality of bead members disposed along the length.

A first guide track is positioned proximate the opening. The first guide track has a length and preferably a race or a cutout portion configured to guide said first plurality of bead members along the length upon movement of said cover between said open position and said closed position. A second guide track is positioned proximate the opening to be covered and is spaced from the first guide track. The second guide track also has a length, a first end and preferably a race or a cutout portion configured to guide the second plurality of bead members upon movement of the cover between the open position and the closed position.

A first positive drive is a suitable mechanism for urging the beads of said first plurality of beads into or out of the race. At present, the first positive drive has a first bead sprocket and a housing. The first bead sprocket has a circumferential wall and a plurality of inverse teeth positioned there through, each one of the plurality of inverse teeth being sized and configured to engage a portion of a corresponding one of the first plurality of guide beads. The housing has a first end positioned proximate the first end of the first guide track and a receiving surface configured to receive a portion of the circumferential wall of the bead sprocket. The receiving surface has a recess portion positioned there through and configured to guide the first plurality of guide beads along the receiving surface. The recess portion communicates with the cutout portion of the first guide track.

A second positive drive is also a suitable mechanism for urging the beads of said first plurality of beads into or out of the race. At present the second positive drive has a second bead sprocket and a housing. The second bead sprocket has a circumferential wall and a plurality of inverse teeth positioned there through, each one of the plurality of inverse teeth being sized and configured to engage a portion of a corresponding one of the second plurality of guide beads. The housing has a first end positioned proximate the first end of the second guide track and a receiving surface configured to receive a portion of the circumferential wall of the bead sprocket. The receiving surface has a recess portion positioned there through and configured to guide the second plurality of guide beads along the receiving surface. The recess portion communicates with the cutout portion of the second guide track.

A drive means rotates the first bead sprocket and the second bead sprocket of the first and second positive drives, respectively. The drive means can be electric, hydraulic or manually operated. A take-up drum is connected to one of the bead sprockets by a pulley and belt arrangement and functions to collect the cover when in the retracted or partially retracted position.

DETAILED DESCRIPTION OF THE PREFERRED EMBODIMENT

Figure 1:
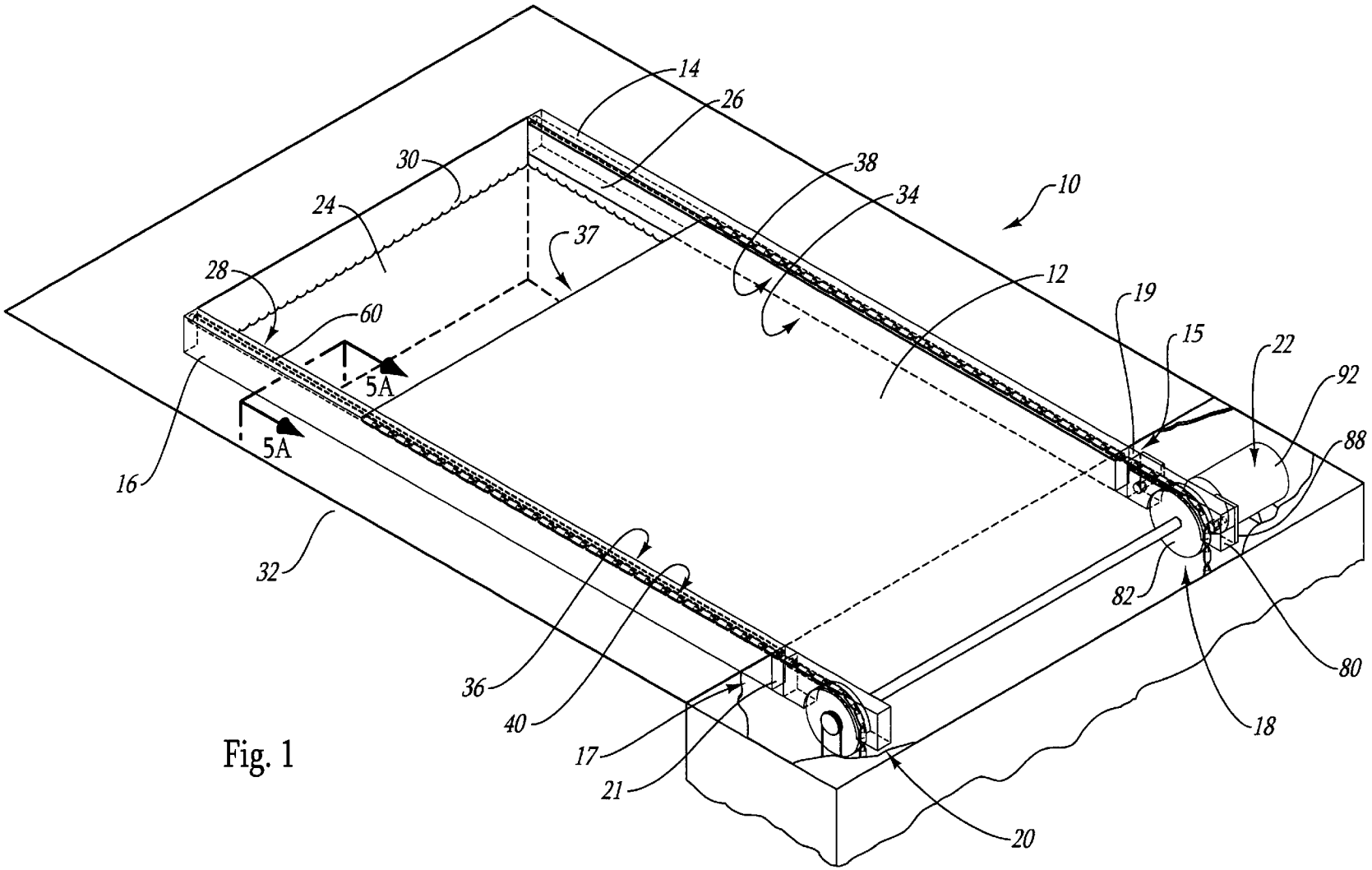
FIG. 1 is a perspective view of an enclosure system of the present invention.

Referring to FIG. 1, an enclosure system 10 generally includes a cover 12, a first guide track 14, a second guide track 16, a first positive drive 18, a second positive drive 20 and a drive means 22. The enclosure system 10 retractably positions the cover 12 over an opening of a space to be enclosed, such as, for example, a swimming pool 24. The enclosure system 10 operates by driving the cover 12 between an open or retracted position, in which the opening of the space to be enclosed is substantially uncovered, and a closed position, in which the opening of the space to be enclosed is substantially covered. Use of the terms "substantially covered" and "substantially uncovered" herein indicates that the opening of the space to be enclosed need not be perfectly covered or uncovered by the enclosure system 10.

The swimming pool 24 illustrated in FIG. 1 represents a wide variety of swimming pool and other configurations that exhibit a space to be enclosed. For example, the enclosure system 10 described herein can be made to work equally well for swimming pools that are oval in shape, or that are elliptical or kidney shaped. With swimming pools that are oval in shape, for example, the first and second guide tracks 14, 16, although positioned parallel to one another, will not necessarily be in alignment with any particular wall of the swimming pool. Further, the enclosure system 10 can be used for ponds, recessed spas, and tiered or terraced pools. Still further, the enclosure system 10 described herein can be configured to enclose a wide range of shaped openings or spaces that benefit from periodic covering and uncovering.

Figure 2:
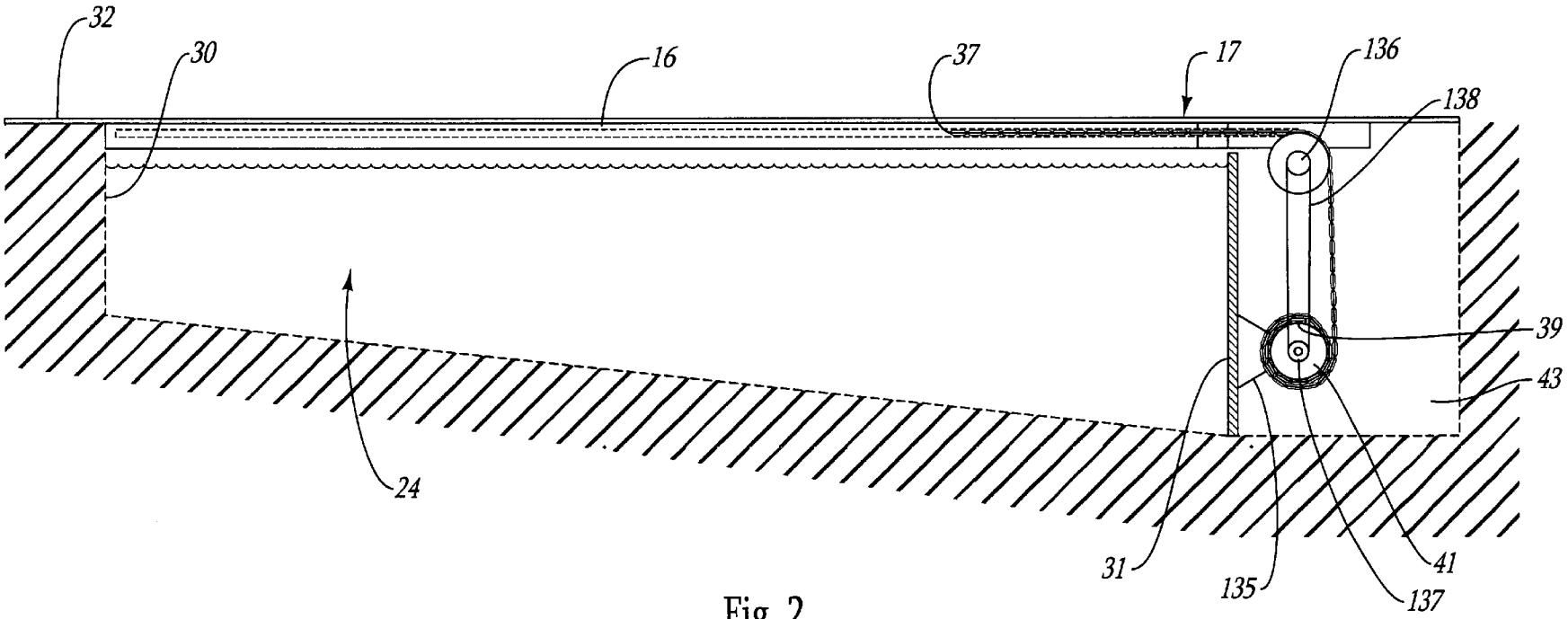
FIG. 2 is a cross sectional view of the enclosure system illustrated in FIG. 1.

Referring to FIGS. 1 and 2, the swimming pool 24 is illustrated as including a first side wall 26, a second side wall 28, a front wall 30, which is the wall opposite the positive drives 18, 20, and a rear wall 31. The swimming pool 24 also has a deck or surface 32 that surrounds the four walls of the pool. The shape and dimensions of the deck or surface 32 are not critical, but the deck or surface 32 must nonetheless provide a stable structure from which to secure the first and second guide tracks 14, 16 adjacent to the opening of the space to be enclosed.

The first guide track 14 and the second guide track 16 are mounted on top of the deck or surface 32 proximate the two side walls 26, 28. More particularly, the first guide track 14 and the second guide track 16 are positioned close to and in alignment with the first side wall 26 and the second side wall 28, respectively. Further, the first guide track 14 and the second guide track 16 are mounted, preferably, parallel to one another. The guide tracks 14, 16 are secured to the deck or surface 32 using any suitable means. A preferred means, however, is to secure the guide tracks 14, 16 to the deck or surface 32 using bolts spaced periodically along the length of the guide tracks 14, 16. The bolts are extended through holes that are bored through the guide tracks and are then fastened to the material that the deck or surface 32 is constructed of, which may be wood, plastic or concrete, for example. Further details regarding the positioning of the guide tracks with respect to the walls of the swimming pool and the mounting of the guide tracks to the deck or surface 32 is disclosed in U.S. Pat. No. 5,913,613 (Ragsdale et al.) and U.S. Pat. No. 5,920,922 (Ragsdale et al.), the disclosure of which are incorporated by this reference.

Still referring to FIG. 1, the cover 12 has a first side edge 34 and a second side edge 36. The second side edge 36 is spaced from and is, preferably, in parallel alignment with the first side edge 34. The cover 12 also has a front edge 37 and a rear edge 39 (see FIG. 2). The rear edge 39 is preferably fastened to a take-up drum 41, but may, alternatively, hang free so as to permit collection of the cover 12 in an open box disposed below the deck or surface 32 when the cover 12 is in a fully or partially retracted position. The cover 12 is constructed using any suitable fabric . Preferably, however, the cover 12 is constructed from vinyl material reinforced with a polyester mesh to increase strength and wear resistance. The thickness 67 of the cover 12 in this embodiment is about four-tenths (4/10) of a millimeter (or about 0.015 inches). Materials of other thickness may be used being mindful that thicker material increases the weight and in turn may dictate a need for stronger components and a more powerful drive means 22.

Figure 3B:
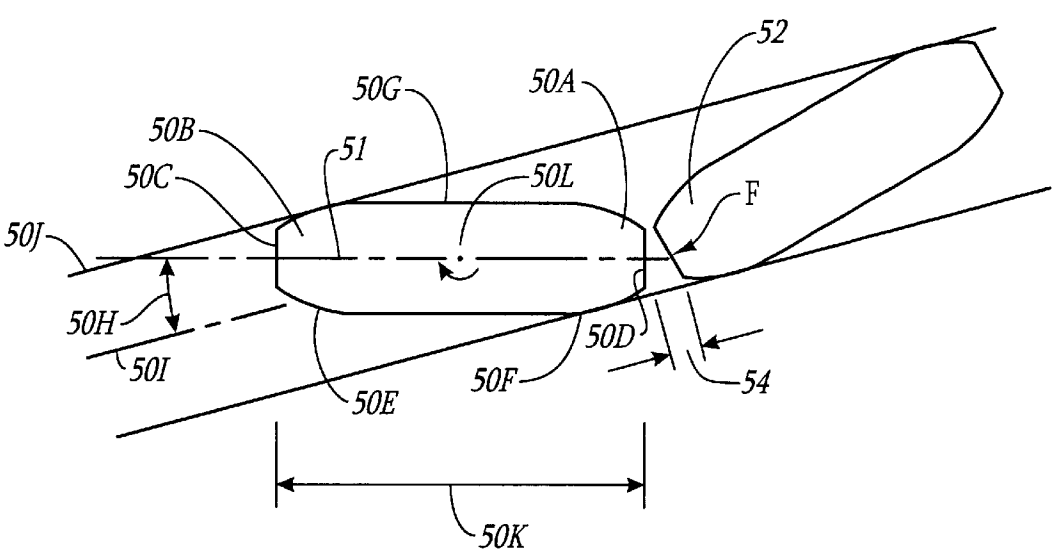
FIG. 3B is a close-up view of an edge bead in a guide track.
Figure 4:
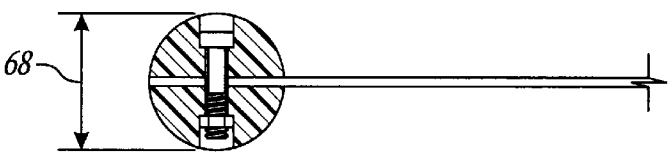
FIG. 4 is a partial cross sectional depiction of an edge bead secured to the cover taken along the line 4—4 as shown in FIG. 3A.
Figure 3A:
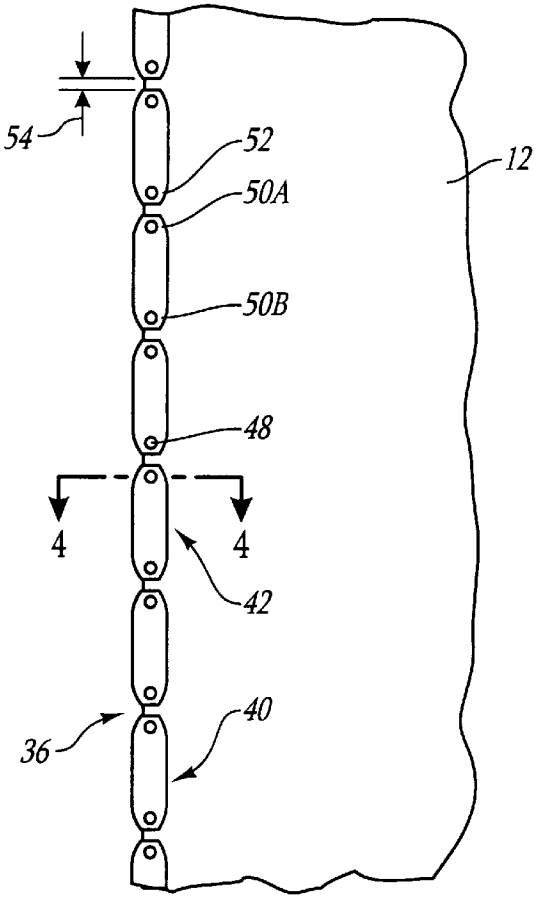
FIG. 3A is a partial view of an edge of the pool cover illustrating a plurality of edge beads disposed thereon.

Disposed along the first side edge 34 and the second side edge 36, respectively, are a first plurality of edge beads 38 and a second plurality of edge beads 40. Referring more specifically to FIGS. 3A, 3B and 4, an individual edge bead 42 of one of the first and second pluralities of edge beads 38, 40 is illustrated as having a first section 44 and a second section 46 (the individual edge bead 42 is representative of each edge bead contained in the first and second pluralities of edge beads). The first and second sections 44, 46 are secured to the second side edge 36 using a pair of rivets 48 or some other suitable fastening device, such as spikes or prongs. Indeed, securement of the beads to the cover or fabric at the edges may be effected by any arrangement that precludes separation with substantial forces that may arise with water collecting on the cover or even people or animals on the cover. Each one of the edge beads of the first and second pluralities of edge beads 38, 40 are secured to their respective edges 34, 36 in a similar fashion. The edge beads, when assembled to the cover 12, have a diameter 68 that is from about five (5) millimeters to about fifteen (15) millimeters, and that is, preferably, about nine (9) millimeters (or about 0.375 inches). The length of each edge bead is from about fifteen (15) millimeters to about thirty (30) millimeters and is, preferably, about twenty five (25) millimeters (or about one inch). An aspect ratio of the edge beads, which is equal to the length divided by the diameter, is preferably about three (3), but may also be from about two (2) to about four (4), for the embodiment here described. Certainly beads of other shapes including cylindrical and even rectangular are within contemplation. Other aspect ratios and sizes are also contemplated.

When the edge beads are secured to their respective edges 34, 36, the front tip 50 of each edge bead will, preferably, abut the rear tip 52 of the adjacent edge bead. In practice, the distance 54 between the front tip 50 and the rear tip 52 is from zero (i.e., the tips abut one another) to less than about one (1) millimeter. The beads are mounted to abut one another. A very small, almost non-existent, distance 54 may be found between some of the tips 50, 52 of adjacent edge beads. An abutting relationship is believed to facilitate the closing of the pool cover (as discussed below) by preventing binding of the edge beads in their respective guide tracks 14, 16.

Referring to FIG. 3B, the edge beads can be seen to have rounded ends or tips 50A, 50B, 52 which are elliptical in cross section and can be approximately hemispherical with a blunt or transverse portion 50C and 50D along or on the axis 51 of the bead to facilitate force transmission when in alignment. The arcuate portions 50E and 5OF from the exterior wall 50G of the bead to the blunt or transverse portion 50C and 50D has a radius or shape selected so that if the bead is not in axial alignment in the track but, rather, is cocked or at some angle 50H relative to the axis 50I of the track (or more particularly the cut out portion or race 50J), then the bead will not jam. Rather, the friction is sufficiently small in magnitude such that the bead will slide or move within the cutout portion or race 50J of the track. The length 50K of the bead is also selected so that if or when a bead is cocked relative to the axis 50I of the cutout portion of the track, the bead cannot become wedged or jammed into the cutout portion of the track by application of a force F to one end 50A of the bead. In other words, the bead cannot rotate 50M about its center point 50L and become wedged against the interior surface of the cutout portion 50J.

The edge beads and the first guide track 14 and the second guide track 16 are, preferably, constructed from any suitable material that allows for the slideable relationship between the track and the beads while being less prone to corrosion. Acetal (which may be obtained from Dupont under the tradename Delrin) has been found to be suitable. Other suitable materials being contemplated include aluminum, stainless steel, nylon, teflon and alnico.

Figure 5B:
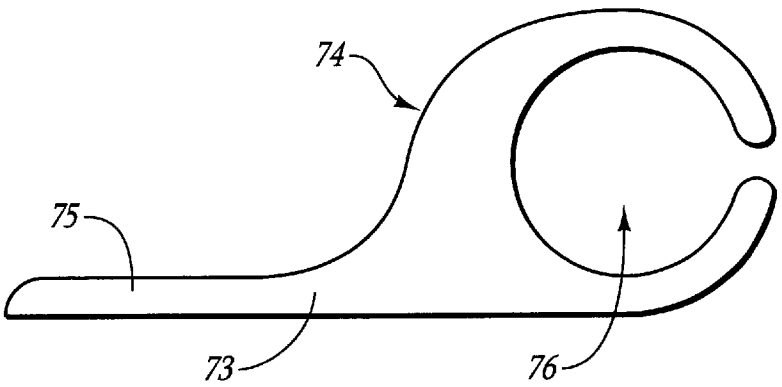
FIG. 5B is a cross sectional view of an alternative construction for a guide track of the present invention.
Figure 5A:
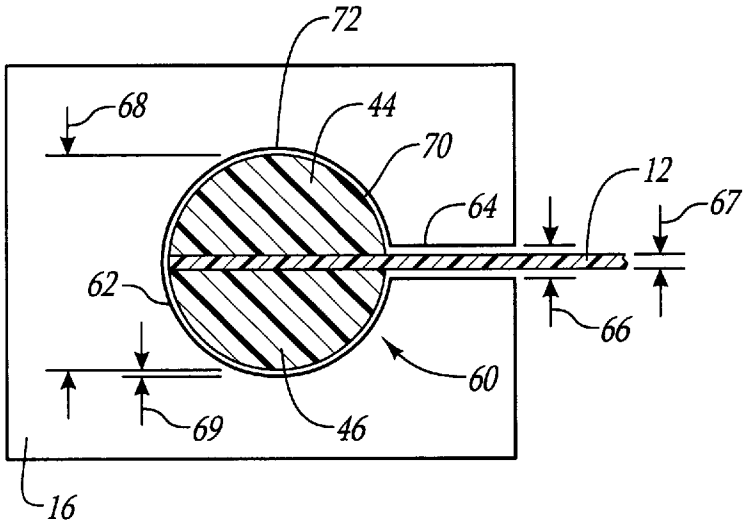
FIG. 5A is a cross sectional view of a guide track taken along the line 5A—5A as shown in FIG. 1.

The first guide track 14 and the second guide track 16 function, in part, to guide the first side edge 34 and the second side edge 36, respectively, during operation of the enclosure system 10. The guide tracks 14, 16 also function to secure the cover 12 in place over the opening of the space to be enclosed when the cover 12 is substantially closed. Referring more specifically to FIGS. 5A and 5B, the second guide track 16 has a cutout portion 60 that spans the length of the track (the first guide track 14 mirrors the second guide track 16 in construction, so only the shape and construction of the second guide track 16 is discussed). The cutout portion 60 has a wall 62 that is, preferably, circular in cross section. Notwithstanding the preference for a wall 62 that is circular in cross section, the wall 62 may exhibit other cross sectional geometries as well, depending on the cross sectional geometry of the assembled edge beads. As described and illustrated herein and above, however, it should be appreciated that circular or slightly elliptical cross sections for the wall 62 are preferred, as circular or slightly elliptical cross sectional shapes for the assembled edge beads are preferred.

The cutout portion 60 which can also be called a race also has a side opening 64 that is sized to accept the cover 12 but that is not so large that the edge beads can become dislodged from the track. In other words, the side opening 64 has a width 66 that is slightly larger than the thickness 67 of the cover 12 but that, at the same time, is smaller than the diameter 68 of the assembled edge bead. The tolerance 69 between the outer surface 70 of the edge bead and the inner surface 72 of the wall 62 is selected to allow for temperature changes while minimizing any binding of the beads in the cutout or race. Tolerances may vary based on the geographical location of the pool and on the materials selected. For the illustrated embodiment, the tolerance 69 is, preferably, about three-tenths (3/10) of a millimeter (or about 0.0135 inches). Similarly, the width 66 of the side opening 64 may vary and for the present embodiment is about three (3) millimeters (or about 0.125 inches). An alternative cross sectional geometry for the construction of the guide tracks 14, 16 is illustrated in FIG. 5A. Here, guide track 73 is shown having a curved outer profile 74 and a flat section 75. The dimensions of the cutout portion 76 are essentially the same as those described above.

While the track is here shown with a race or cutout portion sized to receive a bead, it should be understood that the track may also be a simple rod supported by a plurality of pins attached to a support surface. The beads are C-shaped in cross section with an interior sized to snugly and slideably fit over the rod so that they may slide there along.

Figure 6:
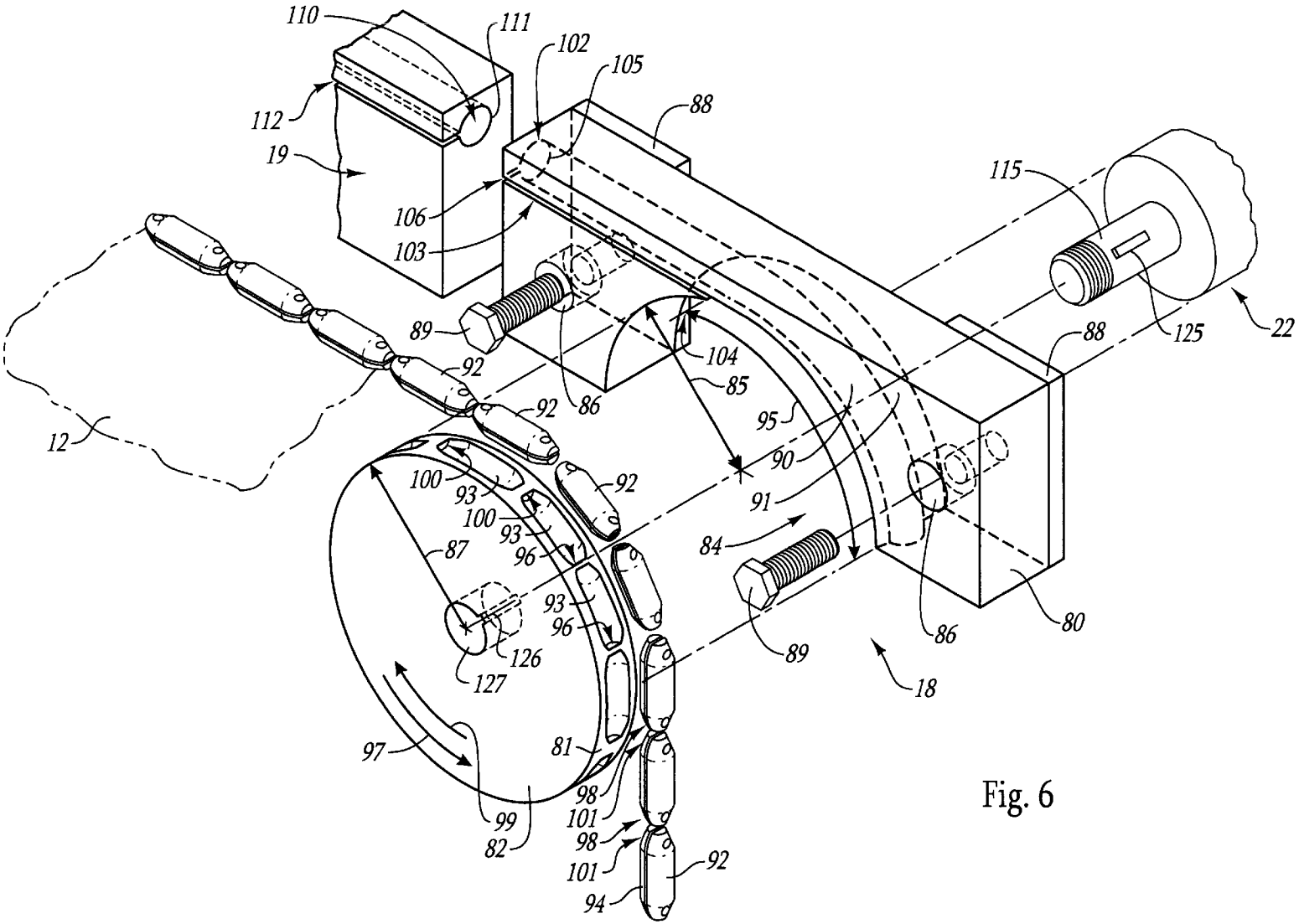
FIG. 6 is an exploded view of a positive drive mechanism shown in FIG. 1.

Referring again to FIG. 1, the first positive drive 18 is secured adjacent to the first end 15 of the first guide track 14. Likewise, the second positive drive 20 is secured adjacent to the first end 17 of the second guide track 16. Referring now to FIG. 6, the first positive drive 18 includes a housing 80 and a bead sprocket 82 (the second positive drive 20 mirrors the first positive drive 18, so only the construction of the first positive drive 18 is discussed here). The housing 80 has a cutaway portion 84 that is sized and configured to accept the bead sprocket 82 therein. The cutaway portion 84 is semi-circular in shape and has a radius 85. The bead sprocket 82 is circular in shape and has a radius 87 that is slightly smaller than the radius 85 of the cutaway portion 84, thus allowing the bead sprocket 82 to rotate within the cutaway portion 84 of the housing 80.

The housing 80 is secured to a bracket means 88 by a pair of bolts 89 that extend through respective bolt holes 86 that are positioned on opposing sides of the cutaway portion 84. The bracket means 88 is itself secured to the back side of the rear wall 31 of the swimming pool 24, or to some other structure that is fixed with respect to the swimming pool, using any suitable means, such as, for example, bolts. The construction and mounting of bracket means suitable for the present invention is disclosed in the previously referenced U.S. Pat. No. 5,913,613 (Ragsdale et al.) and U.S. Pat. No. 5,920,922 (Ragsdale et al.).

The drive means 22 functions to rotate the bead sprocket 82 inside the cutaway portion 84 of the housing 80. The drive means 22 is preferably an electric motor, but may, alternatively, consist of a variety of other means with which to rotate the bead sprocket 82. Contemplated alternatives to the drive means 22, for example, include an hydraulic system, whereby a power head is used to rotate the bead sprockets and is connected to an hydraulic pump through hydraulic fluid pipes or hoses. The use of hydraulic drive means for similar purposes—i.e., for purposes related to driving a shaft that is part of an enclosure system—is disclosed in the previously referenced U.S. Pat. No. 5,913,613 (Ragsdale et al.) and U.S. Pat. No. 5,920,922 (Ragsdale et al.). Referring to FIGS. 1 and 6, the drive means 22 is illustrated as being connected directly to the edge bead sprocket 82 by a drive shaft 115.

Still referring to FIG. 6, the housing 80 has a recess strip 90 that is formed on an inner wall or receiving surface 91 of the of the cutaway portion 84. The recess strip 90 is sized and configured to accept therein the upper portion 92 of the edge bead members as the edge bead members traverse the arc length 95 of the recess strip 90. The edge bead sprocket 82 has an outer or circumferential wall 81 with a plurality of inverse teeth 93 extending partially there through and sized and configured to accept therein the lower portion 94 of the edge bead members. With the inverse teeth 93 and the recess strip 90 so sized and configured, the edge beads become sandwiched between the housing 80 and the edge bead sprocket 82 as the edge bead sprocket 82 turns within the housing 80. It is noted here that the cutaway portion 84 is illustrated as being semi-circular in projection along the axis of the edge bead sprocket 82. Nonetheless, the cutaway portion 84 may be formed such that the inner wall or receiving surface 91 and the recess strip 90 extend a further distance about the circumference of the edge bead sprocket 82.

The recess strip 90 terminates at the leading or front-most edge 104 of the arc length 95. At this location, the recess strip 90 merges into a second cutout portion 103 which has the same cross sectional dimensions and shape as the cutout portion 60 belonging to the corresponding guide track. In other words, the second cutout portion 103 has a wall 105 and a side opening 106 that are sized and configured to be compatible with the wall 62 and side opening 64 of the guide track above described.

A first connector track 19 is, if desired, positioned between the first end 15 of the first guide track 14 and the housing 80 of the first positive drive 18. Likewise, a second connector track 21 is positioned between the first end 17 of the second guide track 16 and the housing 80 of the second positive drive 20. The connector tracks 19, 21 have a cutout portion 110 and corresponding walls and side openings that form a smooth-walled and continuous link between the edge bead exit and entry port 102 and the cutout portion 60 located at the first end 15, 17 of the corresponding guide track 14, 16. In other words, the cutout portion 110 has a wall 111 and a side opening 112 that are sized and configured to be compatible with the wall 62 and side opening 64 of the guide track above described and with the wall 105 and side opening 106 of the second cutout portion 103 above described. The connector tracks 19, 21 are positioned at points expected to be most prone to wear from the forced entry of the edge beads into the guide tracks and facilitate maintenance, replacement and repair of the enclosure system 10 without having to replace the guide tracks 14, 16.

As the edge bead sprocket 82 rotates within the cutaway portion 84 of the housing 80, the edge beads are gripped by the inverse teeth 93 and thereby forced to move in the direction of rotation of the edge bead sprocket 82. More specifically, when the edge bead sprocket 82 rotates in the closing direction 97—i.e., the direction whereby the cover 12 is pushed out and over the top of the swimming pool 24—the trailing edge 96 of each inverse tooth 93 will abut the trailing edge 98 of the lower portion 94 of a corresponding edge bead and force the edge bead to move in the direction of rotation 97 along the arc length 95 of the recess strip 90. As each edge bead passes by the leading or front-most edge 104 of the arc length 105 (or the recess strip 90) each edge bead is forced into the second cutout portion 103 of the housing 80. Each edge bead is then forced along the length of the second cutout portion 103 and then into and along the cutout portion 110 of the respective connector track 19, 21. Finally, each edge bead emerges from the cutout portion 110 of the connector track 19, 21 and enters the cutout portion 60 of the guide track 14, 16 where each edge bead is then forced along the length of the guide track 14, 16 in the cutout portion 60 thereof.

It should be appreciated from the discussion above that the edge beads, when connected to the cover 12 such that the rear tip 52 of each bead abuts the front tip 50 of an adjacent bead, are forced along their respective guide track 14, 16 by the force applied through the adjacent bead. In other words, when the edge beads are lined up in their respective guide track, a "segmented rod" is simulated whereby the force applied to the bead just exiting the recess strip 90 is transmitted to and through each of the edge beads that are then lined up in a respective guide track 14, 16. As mentioned above, the close tolerance between the outer surface 70 of the edge bead and the inner surface 72 of the wall 62 (as is the case with the second cutout portion 103 and the cutout portion 110 that is formed in the connector track 19, 21) prevents the edge beads from overlapping or becoming kinked in the guide track 14, 16. Hence, the action of the positive drive 18, 20 forces the edge beads, together with the cover to which they are attached, along the guide track 14, 16 as the cover 12 is being closed over the swimming pool 24.

In a similar fashion, when the edge bead sprocket 82 rotates in the opening direction 99, such that the cover 12 is retracted from over the top of the swimming pool 24, the leading edge 100 of each inverse tooth 93 will abut the leading edge 101 of the lower portion 94 of a corresponding edge bead and force the edge bead to move in the opening direction of rotation 99 along the arc length 95 of the recess strip 90. When the bead sprocket 82 rotates in the opening direction 99, however, the edge beads are no longer "pushed" down the guide track 14, 16 but, rather, are "pulled" together with the cover 12 to which they are attached.

Figure 7B:
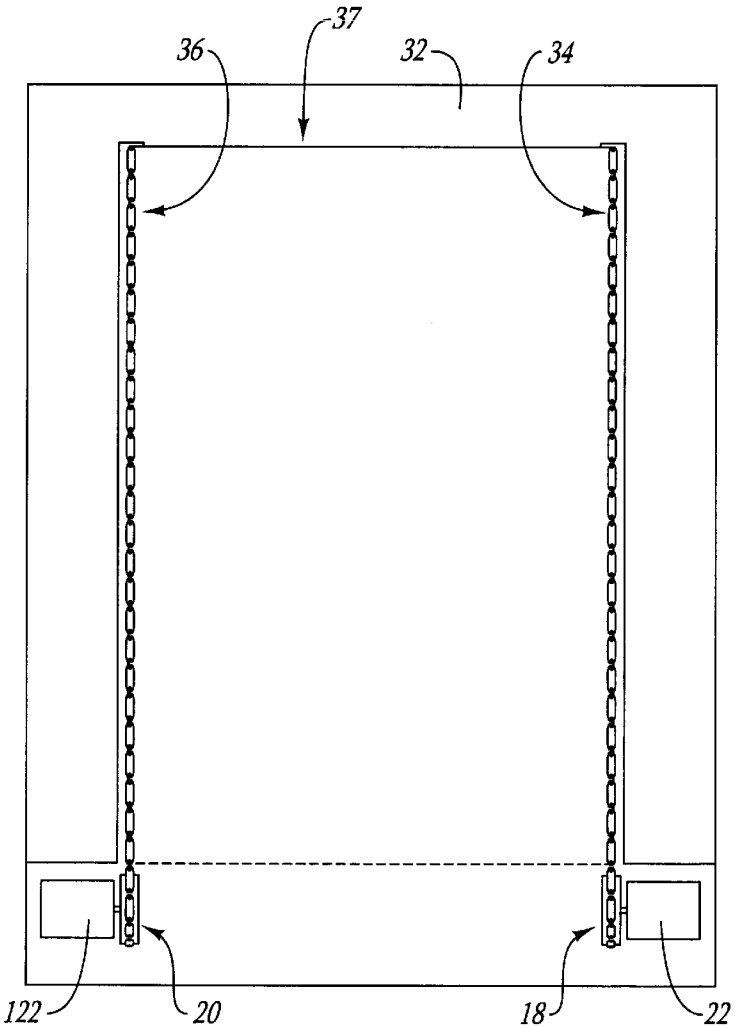
FIG. 7B is an overhead view of an enclosure system of the present invention showing a drive means attached to each of the positive drive mechanisms.
Figure 7A:
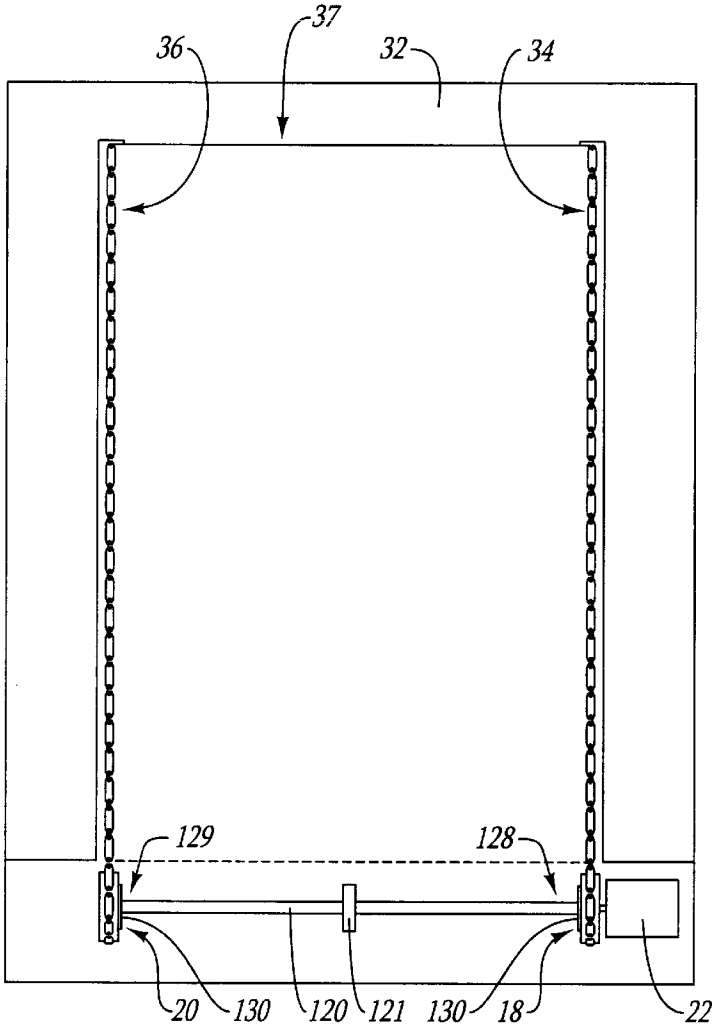
FIG. 7A is an overhead view of an enclosure system of the present invention showing a single drive means with a drive shaft disposed between the positive drive mechanisms.

Referring to FIGS. 7A and 7B, two preferred arrangements for rotating the bead sprockets are illustrated. In FIG. 7A, for example (see also FIG. 1), a single drive means 22 is used to rotate the bead sprockets 82 in both the first positive drive 18 and the second positive drive 20. This arrangement employs a shaft 120 that extends from the edge bead sprocket 82 of the first positive drive 18 to the edge bead sprocket 82 of the second positive drive 20. The first and second ends 128, 129 of the shaft 120 are connected to the edge bead sprockets 82 of the first and second positive drives 18, 20 using any suitable means, such as, for example, by flanges 130 that are threaded onto the ends of the shaft and then bolted to the respective edge bead sprockets 82. The shaft 120 is held in position by bearings 121 as needed—i.e., the bearings 121 are spaced along the length of the shaft 121 in a number and spacing there between that depends on the width of the pool 24 and the length of the shaft 120. The bearings 121 are secured to the back side of the rear wall 31 of the swimming pool 24, or to some other structure that is fixed with respect to the swimming pool, using any suitable means, such as by bearing housings that are themselves fastened to a bracket means in a manner similar to that discussed above with respect to the housing 80.

In FIG. 7B, an alternative arrangement is illustrated whereby a second drive means 122 is connected directly to the edge bead sprocket 82 of the second positive drive 20 in a manner similar to that used to connect the drive means 22 to the edge bead sprocket 82 of the first positive drive. That is, and by way of analogy with the first positive drive, a key 125 is set in a groove in the drive shaft 115 and mates with a corresponding groove 126 that is cut into a shaft aperture 127 that extends through the central axis of the edge bead sprocket 82. A nut (not illustrated) then secures the edge bead sprocket 82 onto the drive shaft 115. In the alternative arrangement that employs two drive means 22, 122, care must be taken to ensure that the drive means 22, 122 are timed to rotate the edge bead sprockets 82 of the positive drives 18, 20 such that the edge bead sprockets 82 are in phase with one another. This concern is, however, substantially alleviated when a shaft 120 is disposed between the edge sprockets 82 as illustrated in FIG. 7A.

Finally, a take-up drum 41 is positioned below the positive drives 18, 20 and serves to store the cover 12 when the cover 12 is partially or completely retracted from the swimming pool 24. The take-up drum 41 is mounted to the back side of the rear wall 31 of the swimming pool 24. A bracket means 135 is mounted at both ends of the take-up drum 41 and secured to the wall using bolts or the like. Reference is again made to U.S. Pat. No. 5,913,613 (Ragsdale et al.) and U.S. Pat. No. 5,920,922 (Ragsdale et al.) for details regarding the construction and mounting of suitable brackets. Bearings (not illustrated) are positioned between the brackets 135 and the ends of the take-up drum 41. The take-up drum 41 is rotated using a pulley and belt arrangement. Specifically, a first pulley 136 is secured to the bead sprocket 82 of the second positive drive 20 while a second pulley 137 is secured to the take-up drum 41. A belt 138 connects the first and second pulleys 136, 137 together. The belt is allowed to slip on the pulleys 136, 137 to account for the change in diameter of the take-up drum 41 as the cover 12 is collected thereon or removed therefrom. Alternatively, the cover 12 may be allowed to simply collect in the box-like space 43 that would otherwise house the take-up drum 41.

The enclosure system 10 has been described with reference to particular embodiments in the foregoing description. Various other modes for carrying out the invention are, however, contemplated as being within the scope of the claims that follow and that particularly point out and distinctly claim the subject matter which is regarded as the invention.

What is claimed:

1. A system for extending and retracting a cover, said system comprising:

a cover shaped and sized for positioning over an opening of a space to be covered, said cover being moveable between a closed position in which said cover substantially covers the opening and an open position in which said cover is displaced from said closed position, said cover having a front edge, a first side edge and a second side edge spaced from said first side edge, said first side edge having a first edge length and said second side edge having a second edge length;

a first plurality of bead members attached to said cover along said first edge length of said first side edge;

a second plurality of bead members attached to said cover along said second edge length of said second side edge;

a first guide track positioned proximate said space to be covered, said first guide track having a first track length, a first end and a second end, said first guide track being configured to slideably receive and guide said first plurality of bead members along said first track length upon movement of said cover between said open position and said closed position;

a second guide track positioned proximate said space to be covered and spaced from said first guide track, said second guide track having a second track length, a first end and a second end, said second guide track being configured to guide said second plurality of bead members along said second track length upon movement of said cover between said open position and said closed position;

a first positive drive configured to move bead members of said first plurality of bead members into and out of said first track to urge said cover between said open position and said closed position;

a second positive drive configured to move bead members of said first plurality of bead members into and out of said second track to urge said cover between said open position and said closed position;

drive means operably connected to said first positive drive and to said second positive drive for operating said first positive drive and said second positive drive; and receiver means positioned relative to said first positive drive and said second positive drive for receiving said cover from and supplying said cover to said first positive drive and said second positive drive as said cover is moved between said open position and said closed position.

2. The system of claim 1 wherein said first positive drive includes a first bead sprocket having a first circumferential wall with a plurality of inverse teeth formed there through, each of said plurality of inverse teeth being sized and configured to engage at least a portion of each of said first plurality of guide beads.

3. The system of claim 2 including a first housing having a first end positioned proximate said first end of said first guide track, said first housing having a first receiving surface configured to receive a portion of said first circumferential wall of said first bead sprocket.

4. The system of claim 3 wherein said first housing is configured to guide said first plurality of guide beads along said receiving surface, said receiving surface having a recess portion formed therein for communicating with said first guide track.

5. The system of claim 4, wherein said second positive drive includes a second bead sprocket having a second circumferential wall with a plurality of inverse teeth formed there through, each of said plurality of inverse teeth being sized and configured to engage a portion of a corresponding one of said second plurality of guide beads.

6. The system of claim 5 including a second housing having a first end positioned proximate said first end of said second guide track, said second housing having a second receiving surface configured to receive a portion of said second circumferential wall of said second bead sprocket.

7. The system of claim 6 wherein said first housing is configured to guide said second plurality of guide beads along said receiving surface, said receiving surface having a recess portion communicating with said second guide track.

8. The system of claim 1, wherein each one of said first plurality of bead members has an upper section and a lower section connected to said upper section.

9. The system of claim 1, wherein each one of said first plurality of bead members has an aspect ratio from about one to about four.

10. The system of claim 1, wherein said housing, said bead sprockets and said guide tracks are made of acetal.

11. The system of claim 1, wherein said housing, said bead sprockets and said guide tracks are made of aluminum.

12. The system of claim 1, wherein said first end of said first guide track is secured to said first end of said first housing.

13. The system of claim 1, wherein said receiver means comprises a space having a depth and wherein said receiver means is positioned below said first positive drive means.

14. The system of claim 1, wherein said receiver means comprises a take-up drum connected to at least one of said first positive drive and said second positive drive by a pulley and belt arrangement.

15. The system of claim 1, wherein said space to be covered is a swimming pool.

16. The system of claim 14, wherein each said lower section is connected to a corresponding upper section using a rivet.

17. The system of claim 1, wherein said drive means includes a first electric motor connected to said first bead sprocket and a second electric motor connected to said second bead sprocket.

18. The system of claim 1, wherein said drive means includes a first electric motor connected to said first bead sprocket and a shaft connecting said second bead sprocket to said first bead sprocket.

19. The system of claim 1, wherein said drive means includes a first hydraulic drive means connected to said first bead sprocket and a second hydraulic drive means connected to said second bead sprocket.

20. The system of claim 1 wherein each one of said first plurality of bead members has a length and a cylindrical portion.

21. The system of claim 20 wherein said first guide track has a cutout portion sized to snugly and slideably receive said first plurality of bead members therein.

22. A system for extending and retracting a cover over a swimming pool, said system comprising:

a cover shaped and sized for positioning over the swimming pool, said cover being moveable between a closed position in which said cover substantially covers the swimming pool and an open position in which said cover is displaced from said closed position, said cover having a front edge, a first side edge and a second side edge spaced from said first side edge, said first side edge having a first edge length and said second side edge having a second edge length;

a first plurality of bead members attached to said cover along said first edge length of said first side edge, each of said bead members of said first plurality of bead members having a length and being cylindrical along a portion of said length;

a second plurality of bead members attached to said cover along said second edge length of said second side edge, each of said bead members of said second plurality of bead members having a length and being cylindrical along a portion of said length a first guide track positioned proximate said space to be covered, said first guide track having a first track length, a first end and a second end, said first guide track having a cutout portion configured to slideably receive and guide said first plurality of bead members along said first track length upon movement of said cover between said open position and said closed position;

a second guide track positioned proximate said space to be covered and spaced from said first guide track, said second guide track having a second track length, a first end and a second end, said second guide track having a cutout portion configured to slideably receive and guide said second plurality of bead members along said second track length upon movement of said cover between said open position and said closed position;

a first positive drive configured to move bead members of said first plurality of bead members into and out of said first track to urge said cover between said open position and said closed position;

a second positive drive configured to move bead members of said first plurality of bead members into and out of said second track to urge said cover between said open position and said closed position;

drive means operably connected to said first positive drive and to said second positive drive for operating said first positive drive and said second positive drive; and receiver means positioned relative to said first positive drive and said second positive drive for receiving said cover from and supplying said cover to said first positive drive and said second positive drive as said cover is moved between said open position and said closed position.

* * * * *